US008050605B2

(12) United States Patent
Hyakutake et al.

(10) Patent No.: US 8,050,605 B2
(45) Date of Patent: Nov. 1, 2011

(54) IMAGE FORMING APPARATUS INCLUDING LOAD APPLYING MEMBER

(75) Inventors: Nobuo Hyakutake, Kanagawa (JP); Taku Fukuhara, Kanagawa (JP); Masaaki Takahashi, Kanagawa (JP); Takashi Kawabata, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 24 days.

(21) Appl. No.: 12/538,543

(22) Filed: Aug. 10, 2009

(65) Prior Publication Data

US 2010/0247168 A1 Sep. 30, 2010

(30) Foreign Application Priority Data

Mar. 26, 2009 (JP) ..... 2009-076219

(51) Int. Cl.
*G03G 15/01* (2006.01)

(52) U.S. Cl. ..... 399/302

(58) Field of Classification Search ..... 399/302, 399/308, 101, 297

See application file for complete search history.

(56) References Cited

U.S. PATENT DOCUMENTS

| | | | | |
|---|---|---|---|---|
| 5,946,525 | A | 8/1999 | Okamura et al. | |
| 2006/0093395 | A1 * | 5/2006 | Igarashi et al. | 399/101 |

FOREIGN PATENT DOCUMENTS

| | | |
|---|---|---|
| JP | 11-007205 | 1/1999 |
| JP | 2000-231277 | 8/2000 |
| JP | 2001-215805 | 8/2001 |
| JP | 2004-109872 | 4/2004 |
| JP | 2007-033938 | 2/2007 |
| JP | 2008-139749 | 6/2008 |

* cited by examiner

*Primary Examiner* — Hoang Ngo
(74) *Attorney, Agent, or Firm* — Fildes & Outland, P.C.

(57) ABSTRACT

An image forming apparatus includes: an image carrier having an endless circumferential surface on which a latent image is formed due to an electrostatic potential difference; a developing device that attaches a toner to the image carrier to form a toner image; an endless intermediate transfer belt that is entrained around a plurality of roll members and moves circumferentially, and contacts the image carrier to transfer the toner image to the intermediate transfer belt; a transferring device that further transfers the toner image that has been transferred to the intermediate transfer belt, to a recording sheet; and a load applying member that cooperates with one of the roll members placed inside the intermediate transfer belt, to nip the intermediate transfer belt to apply a load to the intermediate transfer belt, the load applying member contacting a non-image region of the intermediate transfer belt.

11 Claims, 9 Drawing Sheets

BANDING GRADE

G5 REMARKABLY OCCURS
G4 OCCURS
G3 VISIBLE
G2 SLIGHTLY VISIBLE
G1 INDISTINGUISHABLE

IMAGE FORMING APPARATUS INCLUDING LOAD APPLYING MEMBER

CROSS-REFERENCE TO RELATED APPLICATIONS

This application is based on and claims priority under 35 USC 119 from Japanese Patent Application No. 2009-076219 filed on Mar. 26, 2009.

BACKGROUND

1. Technical Field

The present invention relates to an image forming apparatus for transferring a toner to a latent image due to an electrostatic potential difference, to form a visible image.

2. Related Art

As an image forming apparatus for transferring a toner to an electrostatic latent image formed on an image carrier to form a toner image, an apparatus is widely used in which a toner image formed on an image carrier is once transferred to an intermediate transfer member, and the toner image on the intermediate transfer member is transferred to a recording medium. As an intermediate transfer member, an endless intermediate transfer belt which is circularly moved while being entrained around a plurality of roll members such as a driving roll and a steering roll is often used.

In such an apparatus, a toner image formed on the image carrier is transferred to the intermediate transfer belt at a primary transfer position, and then conveyed to a secondary transfer position by the circular movement of the intermediate transfer belt. At the secondary transfer position, a backup roll which is butted against the inner circumferential surface of the intermediate transfer belt, and a secondary transfer roll which is pressed from the outside of the intermediate transfer belt against the backup roll through the intermediate transfer belt are placed, and a recording medium is overlaid on the intermediate transfer belt and then nipped between the secondary transfer roll and the backup roll.

SUMMARY

According to an aspect of the invention, there is provided an image forming apparatus including: an image carrier having an endless circumferential surface on which a latent image is formed due to an electrostatic potential difference; a developing device that attaches a toner to the image carrier to form a toner image; an endless intermediate transfer belt that is entrained around a plurality of roll members and moves circumferentially, and contacts the image carrier to transfer the toner image to the intermediate transfer belt; a transferring device that further transfers the toner image that has been transferred to the intermediate transfer belt, to a recording sheet; and a load applying member that cooperates with one of the roll members placed inside the intermediate transfer belt, to nip the intermediate transfer belt to apply a load to the intermediate transfer belt, the load applying member contacting a non-image region of the intermediate transfer belt.

BRIEF DESCRIPTION OF THE DRAWINGS

Exemplary embodiments of the present invention will be described in detail based on the following figures, wherein.

DETAILED DESCRIPTION

Hereinafter, embodiments of the invention will be described with reference to the figures.

Figure 1:
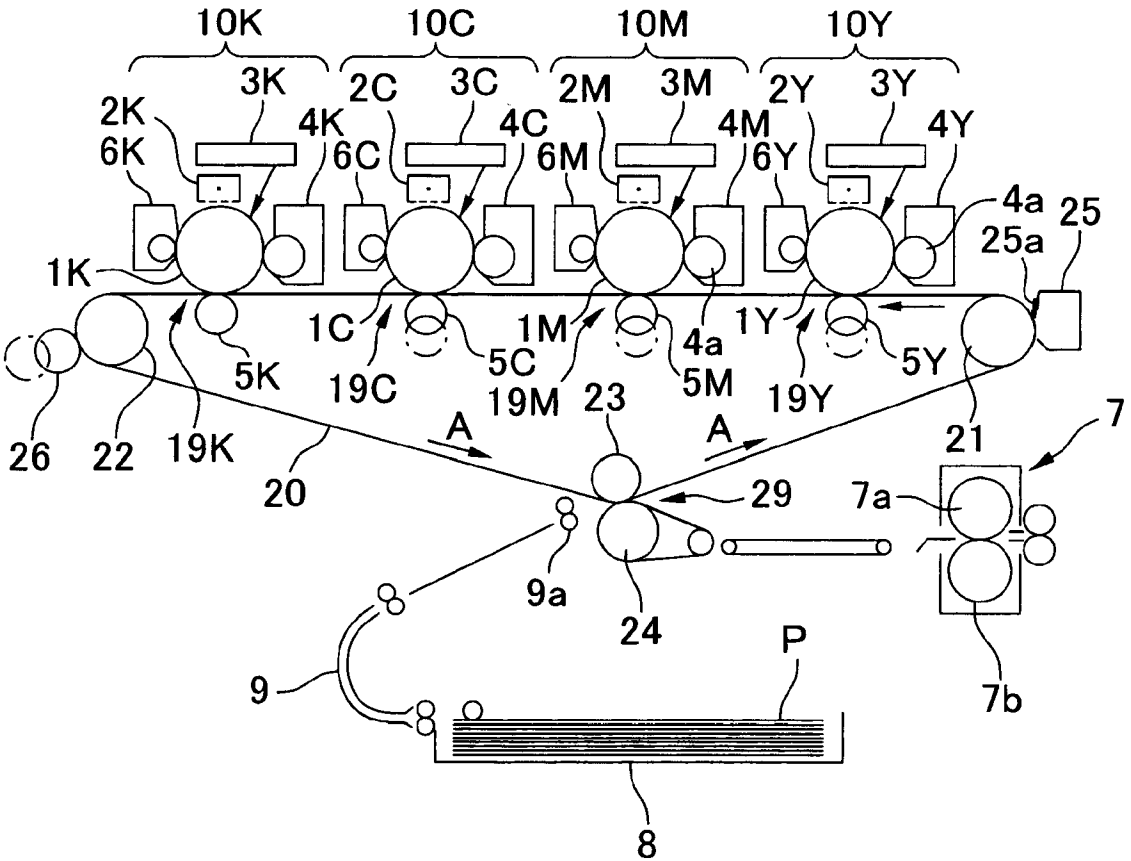
FIG. 1 is a schematic diagram showing an image forming apparatus which is an embodiment of the invention.

FIG. 1 is a schematic diagram of an image forming apparatus which is an embodiment of the invention.

The image forming apparatus is a four-tandem type full-color image forming apparatus, and includes electrophotographic image forming units 10Y, 10M, 10C, 10K which output images of yellow (Y), magenta (M), cyan (C), and black (K), respectively, and an intermediate transfer belt 20 which is opposed to the units. The intermediate transfer belt 20 is disposed so as to be opposed to the image forming units 10, and its circumferential surface is circularly driven. The image forming unit 10Y which forms a yellow toner image, the image forming unit 10M which forms a magenta toner image, the image forming unit 10C which forms a cyan toner image, and the image forming unit 10K which forms a black toner image are sequentially arranged from the upstream side in the circumferential moving direction of the intermediate transfer belt 20. In the downstream side of the units, a secondary transfer roll 24 for performing a secondary transferring process is placed so as to be opposed to the intermediate transfer belt 20. A recording sheet is fed from a sheet tray 8 to a secondary transferring section 29 through a conveying path 9 while being nipped by a register roll 9*a*. In the downstream side from the secondary transferring section 29 in the conveying path 9 for the recording sheet, a fixing device 7 which heats and pressurizes a toner image to fix the toner image onto the recording sheet is disposed, and, in a further downstream side, a discharge tray (not shown) for accommodating a recording sheet onto which a toner image is fixed is disposed.

Each of the image forming units 10 has a photosensitive drum 1 in which an electrostatic latent image is formed in the surface, and which functions as an image carrier, and, around the photosensitive drum 1, includes: a charging device 2 which substantially uniformly charges the surface of the photosensitive drum 1; a developing device 4 which selectively transfers a toner to the latent image formed on the photosensitive drum 1 to form a toner image; a primary transfer roll 5 which primary-transfers the toner image on the photosensitive drum 1 onto the intermediate transfer belt 20; and a cleaning device 6 which removes a residual toner remaining on the photosensitive drum that has undergone the transferring process. For each of the photosensitive drums 1 which are uniformly charged, an exposing device 3 which generates image light based on an image signal is disposed, and the photosensitive drum 1 is illuminated with the image light in the upstream from the position where the drum is opposed to the developing device 4, thereby writing an electrostatic latent image.

The photosensitive drum 1 is formed by stacking an organic photosensitive layer on the circumferential surface of a cylindrical metal-made member. The metal portion is electrically grounded. Alternatively, a bias voltage may be applied.

The charging device 2 includes an electrode wire which is stretched by forming a predetermined gap with the circumferential surface of the photosensitive drum 1. A voltage is applied between the electrode wire and the photosensitive drum 1 to generate a corona discharge, thereby charging the surface of the photosensitive drum 1.

In the embodiment, the device which charges the drum by a corona discharge is used as described above. Alternatively, a solid charger, or a contact or non-contact charging device having a roll- or blade-like shape may be used.

The cleaning device 6 removes a residual toner adhering onto the photosensitive drum, by means of a cleaning blade and cleaning brush which are placed to be contacted with the circumferential surface of the photosensitive drum 1.

The exposing device 3 generates a laser beam which is emitted or not emitted on the basis of the image signal, and scans the photosensitive drum 1 with the laser beam in the main scan direction (the axial direction) by using a polygon mirror. As a result, an electrostatic latent image corresponding to an image of a corresponding color is formed in the surface of the photosensitive drum 1.

The developing device 4 uses a two-component developer containing a toner and a magnetic carrier, and includes a developing roll 4*a* at a position which is close to the photosensitive drum 1. The developing roll 4*a* is rotated while forming a thin layer of the two-component developer on the circumferential surface of the roll. The toner which is consumed in accordance with the image formation is replenished according to the amount of consumption.

Although the two-component developer is used in the embodiment, a one-component developer may be used.

In the primary transfer roll 5, the outer circumferential surface of a metal core member is covered by a conductive rubber material. In each of the image forming units 10Y, 10M, 10C, 10K, the primary transfer roll is placed at a position which is opposed to the corresponding photosensitive drum 1Y, 1M, 1C, or 1K, and which is on the back face side of the intermediate transfer belt 20. When a transfer bias voltage is applied between the primary transfer rolls 5Y, 5M, 5C, 5K and the photosensitive drums 1Y, 1M, 1C, 1K, the toner images on the photosensitive drums are electrostatically transferred to the intermediate transfer belt 20 which passes through the positions where the primary transfer rolls 5Y, 5M, 5C, 5K are opposed to the photosensitive drums 1Y, 1M, 1C, 1K, respectively.

Each of the primary transfer rolls 5 is supported so that the roll can be retracted from the state where the roll is pressed against the photosensitive drum 1 through the intermediate transfer belt 20. In the case where a toner image of the corresponding color is to be formed on the photosensitive drum 1, the primary transfer roll is pressed against the photosensitive drum 1 through the intermediate transfer belt 20, and, in the case where a toner image of the corresponding color is not to be formed, the roll is separated therefrom as indicated by the broken line in FIG. 1.

The fixing device 7 includes a heating roll 7*a* in which a heating source is incorporated, and a pressure roll 7*b* which is pressingly contacted with the heating roll 7*a*. The rolls are placed in parallel to be contacted with each other, thereby forming a nip portion. The recording sheet onto which toner images are transferred is sent to the nip portion, and heated and pressurized between the heating roll 7*a* and pressure roll 7*b* which are rotated, whereby the toner images are compressively bonded onto the recording sheet.

The intermediate transfer belt 20 is configured by forming a film-like member in an endless manner. In the film-like member, for example, a material for applying electrical conductivity, such as carbon or an ion-conductive material is dispersed in a resin material such as polyimide, polyamide-imide, polycarbonate, or a fluororesin, and adjusted so as to attain a predetermined surface resistivity. The intermediate transfer belt is circularly moved in the direction of the arrow A in FIG. 1 while being entrained around a drive roll 21 which is rotated, a steering roll 22 which adjusts deviation in the width direction of the intermediate transfer belt 20, and a backup roll 23.

The drive roll 21 receives a rotational driving force from a driving motor (not shown) to be rotated so that the intermediate transfer belt 20 is circularly moved.

The secondary transfer roll 24 is placed at a position where the roll is opposed to the backup roll 23 through the intermediate transfer belt 20, and transfers the toner images on the intermediate transfer belt to the recording sheet conveyed from the sheet tray 8.

Figure 2:
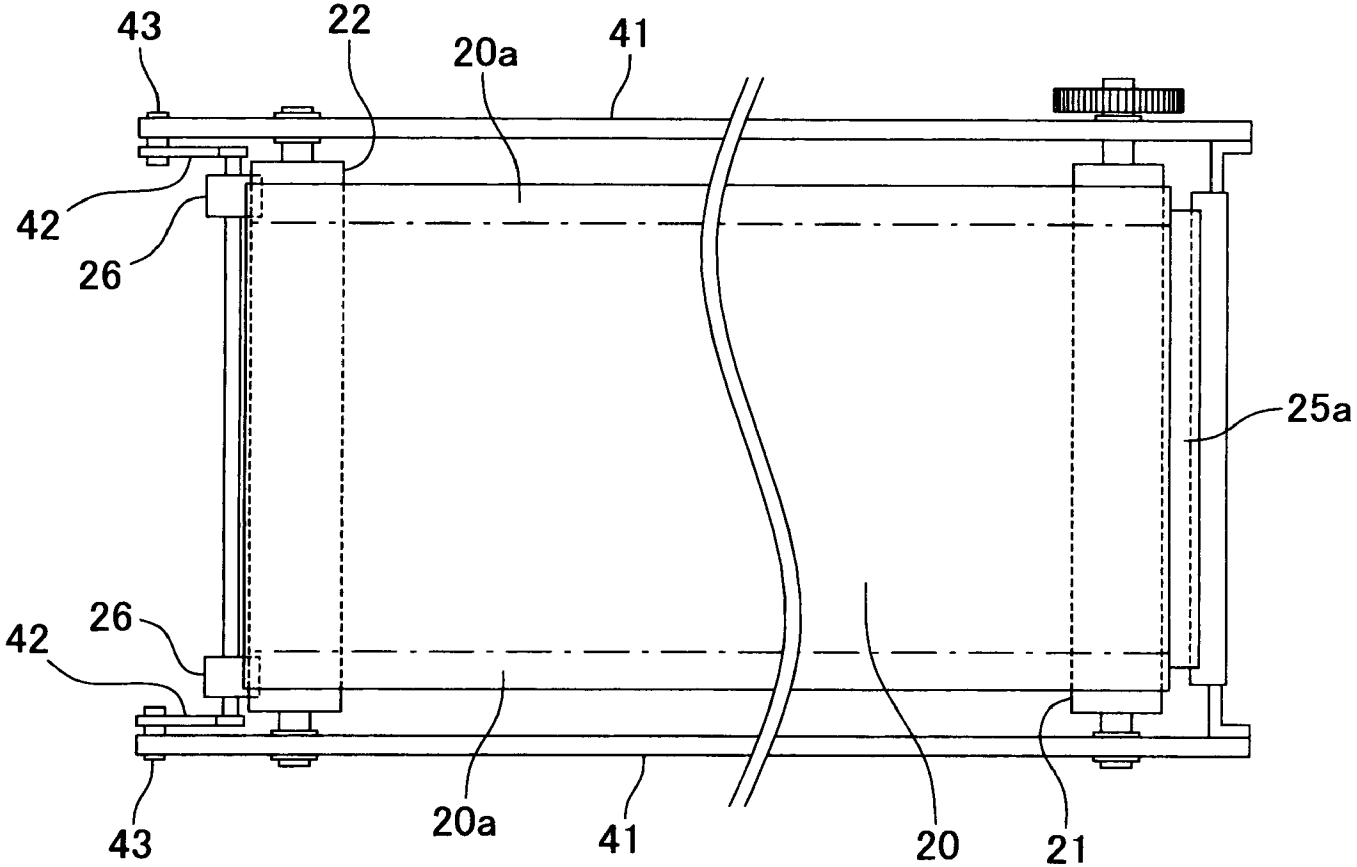
FIG. 2 is a schematic plan view showing an intermediate transfer belt in the image forming apparatus shown in FIG. 1.

Pressing rolls 26 which function as a load applying member are placed at positions where the rolls are opposed to the steering roll 22 through the intermediate transfer belt 20, and press the intermediate transfer belt 20 toward the steering roll 22, from the outer circumferential surface side of the intermediate transfer belt 20. The toner images which are transferred from the photosensitive drums 1 are held on the intermediate transfer belt. As shown in FIG. 2, the pressing rolls 26 are placed so as to press non-image regions 20*a* in the vicinity of the both side edges of the intermediate transfer belt 20 so that the toner images are not affected.

Figure 3:
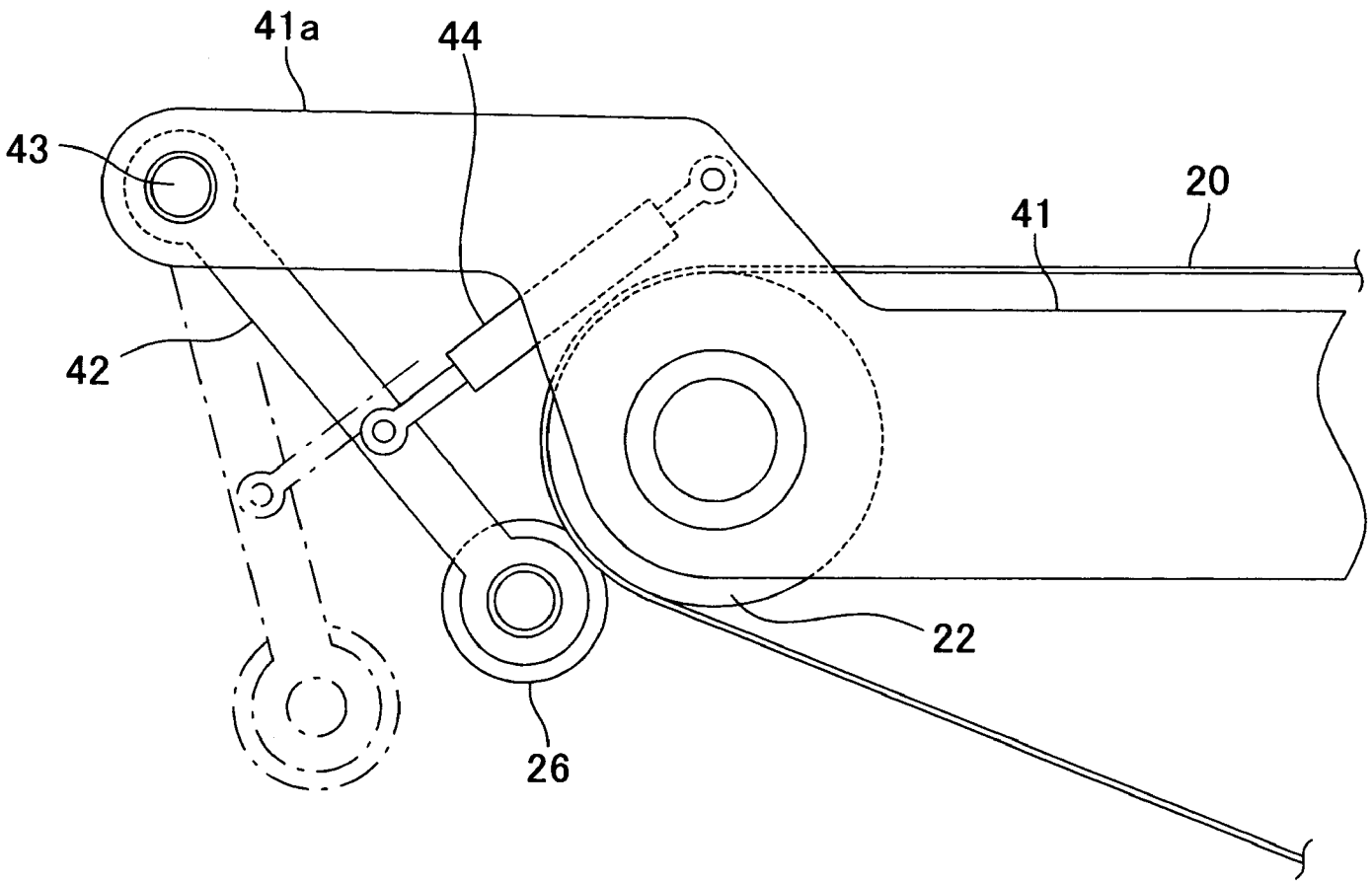
FIG. 3 is a schematic side view showing a structure of supporting a pressing roll used in the image forming apparatus shown in FIG. 1.

In accordance with the full-color mode, the monochrome mode, the thick-sheet mode, or the like, the pressing rolls 26 are contacted with or retracted from the steering roll 22. For example, the pressing rolls can be supported by a structure such as shown in FIG. 3.

The pressing rolls 26 are supported by projected portions 41*a* of a frame 41 supporting the steering roll 22, through swing arms 42. The swing arms 42 are swingably joined to the frame 41 by a rotation shaft 43. The pressing rolls 26 are rotatably supported by the tip ends of the swing arms 42. The swing arms 42 are moved by a driving device 44 supported on the frame 41, to a position where the pressing rolls 26 are pressed against the intermediate transfer belt 20, or that where the pressing rolls are separated from the intermediate transfer belt 20.

The switching to the thick-sheet mode can be performed on the basis of an input by the operator, an input signal from an external apparatus, a signal from a section which detects a thick sheet, or the like.

The pressing rolls 26 are drivenly rotated by the circumferential movement of the intermediate transfer belt 20, and the surface is formed by an elastic material such as a sponge or rubber. When the pressing rolls are pressed against the steering roll 22 by a predetermined pressure, the rolls are elastically deformed, and a load is applied to the circumferential movement of the intermediate transfer belt 20. Therefore, instantaneous fluctuation of the circumferential velocity of the intermediate transfer belt 20 can be suppressed from being propagated in the circumferential direction.

In the embodiment, rolls which are formed by rubber (hardness of 35° [Asker C]), and which have a diameter of 28 mm are used as the pressing rolls 26, and the pressing force which is applied by the pressing rolls 26 to the intermediate transfer belt 20 is set to 5.88 N (600 gf).

On the other hand, a toner removing device 25 is placed at a position where the device is opposed to the drive roll 21 through the intermediate transfer belt 20, so that a cleaning blade 25*a* disposed in the toner removing device 25 is in contact with the intermediate transfer belt 20 to scrape off a residual toner adhering onto the intermediate transfer belt. A load is applied to the circumferential movement of the intermediate transfer belt 20, by contacting the cleaning blade 25*a* with the intermediate transfer belt 20, so that, also at this position, instantaneous fluctuation of the circumferential velocity of the intermediate transfer belt 20 can be suppressed from being propagated.

The thus configured image forming apparatus operates in the following manner.

When the image forming operation is started, the photosensitive drum 1 is rotated, and the surface of the photosensitive drum 1 is substantially uniformly charged to a potential of about −600 to −800 V by the charging device. Then, the exposing device 3 outputs the laser beam which is emitted or not emitted on the basis of image data, and scans the surface photosensitive layer of the photosensitive drum 1 with the laser beam. Therefore, the potential of the irradiation position of the laser beam is lowered, and a latent image due to the electrostatic potential difference is formed in the surface of the photosensitive drum 1.

The electrostatic latent image which is formed in this way is conveyed to a develop position opposed to the developing roll 4*a*, by the rotation of the photosensitive drum 1. When the latent image passes through the develop position, the toner adhering to the developing roll 4*a* is electrostatically transferred to the latent image portion of the surface of the photosensitive drum to form a toner image.

In a primary transferring section 19, the photosensitive drum 1 and the primary transfer roll 5 are opposed to each other through the intermediate transfer belt 20, and the transfer bias voltage is applied between them. When the toner image developed on the surface of the photosensitive drum 1 is conveyed to the primary transferring section 19, an electrostatic force acts on the toner in the electric field formed between the photosensitive drum 1 and the primary transfer roll 5, whereby the toner image on the surface of the photosensitive drum 1 is transferred to the surface of the intermediate transfer belt 20. At this time, the transfer bias voltage applied to the primary transfer roll 5 has the polarity (+) opposite to the polarity (−) of the toner. In the image forming unit 10Y which forms a yellow toner image, for example, a constant current control of about +20 to 30 μA is performed.

In this way, the intermediate transfer belt 20 is sequentially opposed to the respective image forming units 10 so that the color toner images are overlappingly transferred. The intermediate transfer belt 20 onto which all the color toner images are multiply transferred is circularly conveyed in the direction of the arrow A in FIG. 1, to be conveyed to the portion where the backup roll 23 which is contacted with the inner surface of the intermediate transfer belt 20 is in contact with the secondary transfer roll 24 that is placed opposingly to the backup roll.

The recording sheet is conveyed between the secondary transfer roll 24 and the intermediate transfer belt 20 at a predetermined timing, and a secondary transfer bias voltage is applied to the secondary transfer roll 24 and the backup roll 23. At this time, the transfer bias voltage applied to the secondary transfer roll 24 has the polarity (+) opposite to the polarity (−) of the toner, so that an electrostatic force acts on the toner in the formed electric field, whereby the toner images on the surface of the intermediate transfer belt 20 are transferred to the recording sheet. The secondary transfer bias voltage is determined depending on a resistance which is detected by a resistance detecting section (not shown) for detecting the resistance of the secondary transferring section 29, and controlled by a constant voltage.

Thereafter, the recording sheet is fed to the fixing device 7, and the toner images are heated and pressurized, so that the superimposed color toner images are permanently fixed to the surface of the recording sheet.

The recording sheet on which the fixation of the color images has been completed as described above is conveyed toward a discharging portion, and the series of the color image forming operations is ended.

Figure 4:
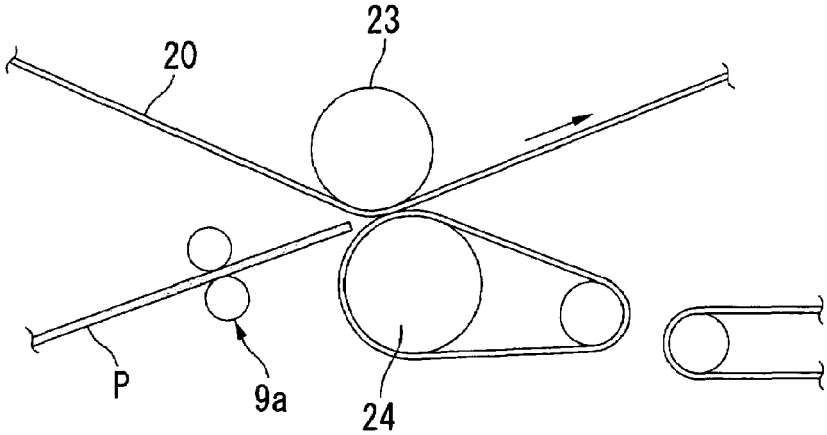
FIG. 4 is a diagram showing a state where load fluctuation occurs in a secondary transfer position in the image forming apparatus shown in FIG. 2.
Figure 5:
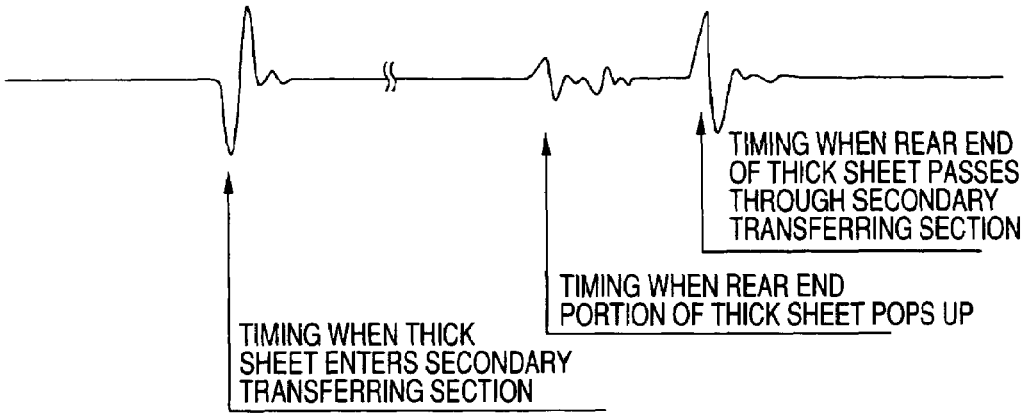
FIG. 5 is a view showing velocity fluctuation of the intermediate transfer belt which is caused by load fluctuation.
Figure 6:
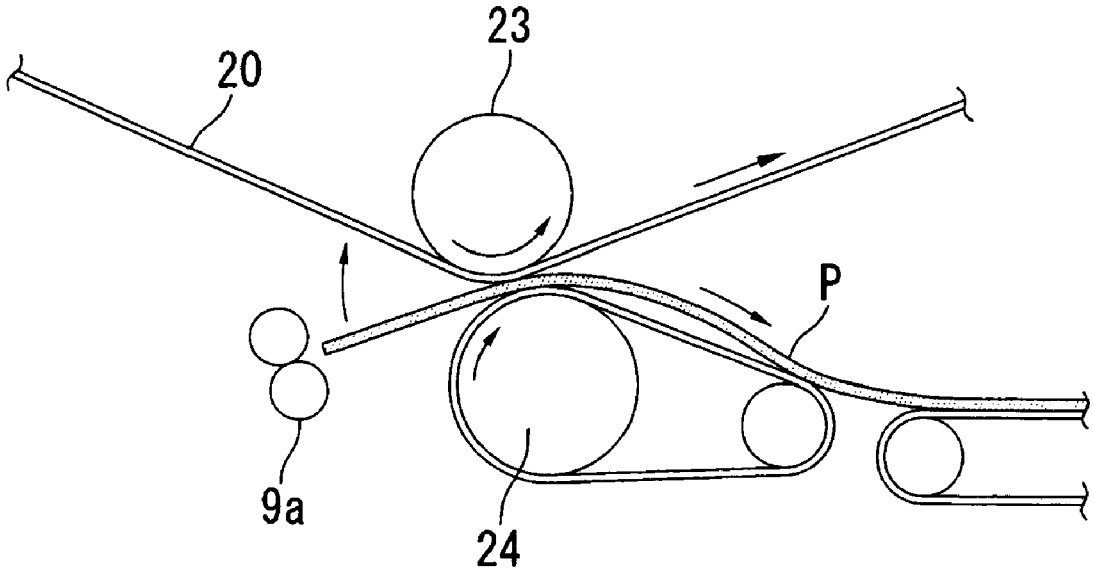
FIG. 6 is a diagram showing a state where load fluctuation occurs in the secondary transfer position in the image forming apparatus shown in FIG. 2.

In the case where a thick sheet is used as the recording sheet in the above-described steps, when the thick sheet enters the secondary transferring section 29, the load for circularly driving the intermediate transfer belt 20 is suddenly changed, and the circumferential velocity of the intermediate transfer belt 20 fluctuates. As shown in FIG. 4, namely, the load suddenly increases at the instant when the tip end of the thick sheet P is nipped between the secondary transfer roll 24 and the intermediate transfer belt 20. As shown in FIG. 5, this causes the circumferential velocity to be once lowered for a very short time immediately after the thick sheet P is nipped, and, as a reaction, a short time when the circumferential velocity is raised thereafter occurs. The thick sheet P is further conveyed in the state where the thick sheet is nipped between the secondary transfer roll 24 and the intermediate transfer belt 20, and, as shown in FIG. 6, the rear end of the sheet then passes over the register roll 9*a* to cancel the constraint. At this time, a rear end portion of the thick sheet P pops up to butt against the intermediate transfer belt 20, whereby the intermediate transfer belt 20 is vibrated so as to be displaced in the direction perpendicular to the circumferential surface. In accordance with this, the tension of the intermediate transfer belt 20 fluctuates, and, as shown in FIG. 5, fluctuation of the circumferential velocity corresponding to the frequency of the vibration occurs. Also when the rear end of the thick sheet P passes through the portion where the secondary transfer roll 24 is opposed to the backup roll 23, the load is suddenly changed in a similar manner, and the circumferential velocity of the intermediate transfer belt 20 is suddenly changed.

Figure 7:
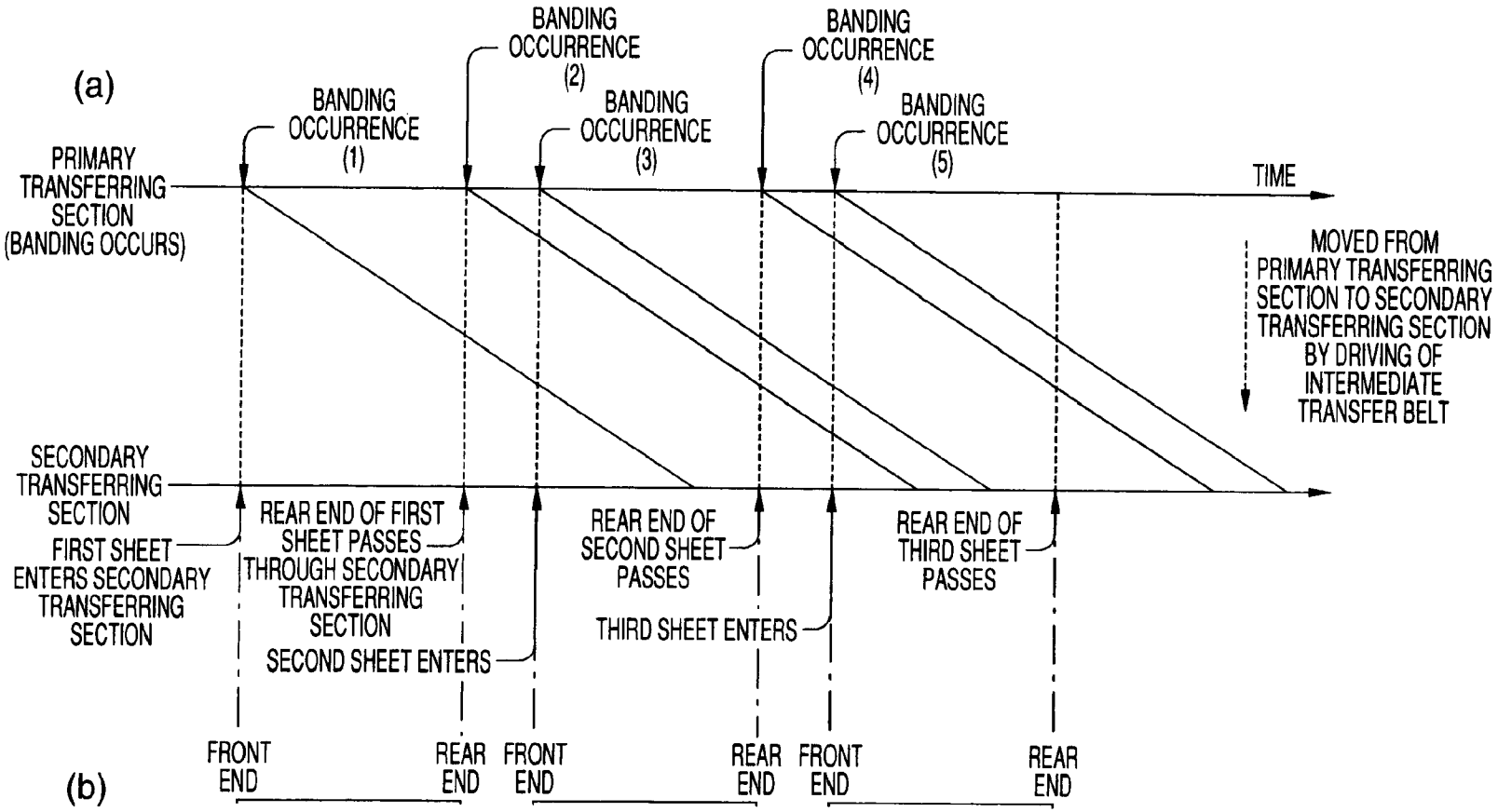
FIG. 7 is a view showing a process in which density unevenness is generated, and the generated density unevenness is transferred to a recording medium.

When the velocity fluctuation which occurs in the intermediate transfer belt 20 in this way propagates to the primary transferring sections 19Y, 19M, 19C, 19K of the image forming units 10Y, 10M, 10C, 10K, and density unevenness which is so-called banding occurs in images transferred in the primary transferring sections 19Y, 19M, 19C, 19K. When the images in which such density unevenness occurs are conveyed to the secondary transferring section 29 by the circumferential movement of the intermediate transfer belt 20, and then transferred to the recording sheet, so that the density unevenness appears as strip- or band-like pattern in the image. As shown in (a) of FIG. 7, density unevenness which, when a first thick sheet enters the secondary transferring section 29, is produced in the primary transferring sections 19 by the fluctuation of the circumferential velocity of the intermediate transfer belt 20 is moved to the secondary transferring section 29, and transferred onto a rear portion of the image transferred to the second thick sheet, or onto a recording sheet which is subsequent to the second thick sheet, so that density unevenness is produced in an image as shown in (b) of FIG. 7.

In the embodiment, by contrast, the pressing rolls 26 are disposed upstream from the secondary transferring section 29 in the circumferential moving direction of the intermediate transfer belt 20 and at the position which is opposed to the steering roll 22, and contacted with the intermediate transfer belt 20, thereby applying a load to the circumferential movement of the intermediate transfer belt 20. The cleaning blade 25*a* is placed while being contacted with the intermediate transfer belt 20, at the position which is downstream from the secondary transferring section 29, and which is opposed to the drive roll 21, and, also in this portion, a load is applied to the intermediate transfer belt 20.

Therefore, propagation of fluctuation of the circumferential velocity to the primary transferring sections 19Y, 19M, 19C, 19K which are disposed between the drive roll 21 and the steering roll 22 is suppressed, and the occurrence of banding is reduced.

On the other hand, when the monochrome mode where an image is formed by using only the black toner is selected, only the image forming unit 10K which forms a black toner image is used, and, in the image forming units 10Y, 10M, 10C which form images of yellow, magenta, and cyan, the primary transfer rolls 5Y, 5M, 5C are retracted from the positions where the rolls are contacted with the intermediate transfer belt 20, and separated from the intermediate transfer belt 20. Furthermore, the intermediate transfer belt 20 is separated also from the photosensitive drums 1Y, 1M, 1C on which toner images of yellow, magenta, and cyan are formed, and in a state where the belt is tensioned without being constrained by another member, in the range from the position where the belt is contacted with the drive roll 21 to that where the belt is contacted with the photosensitive drum 1K on which a black toner image is formed. When the recording sheet passes through the secondary transferring section 29, therefore, vibration in which the intermediate transfer belt 20 is displaced in the direction perpendicular to the circumferential surface easily occurs, and fluctuation of the circumferential velocity is easily propagated.

In the embodiment, also with respect to this, the pressing rolls 26 apply a load to the circumferential movement of the intermediate transfer belt 20, the phenomenon that the velocity of the circumferential movement is fluctuated by vibration of the intermediate transfer belt 20 is suppressed, and density unevenness due to fluctuation of the velocity of the circumferential movement is reduced.

Figure 10:
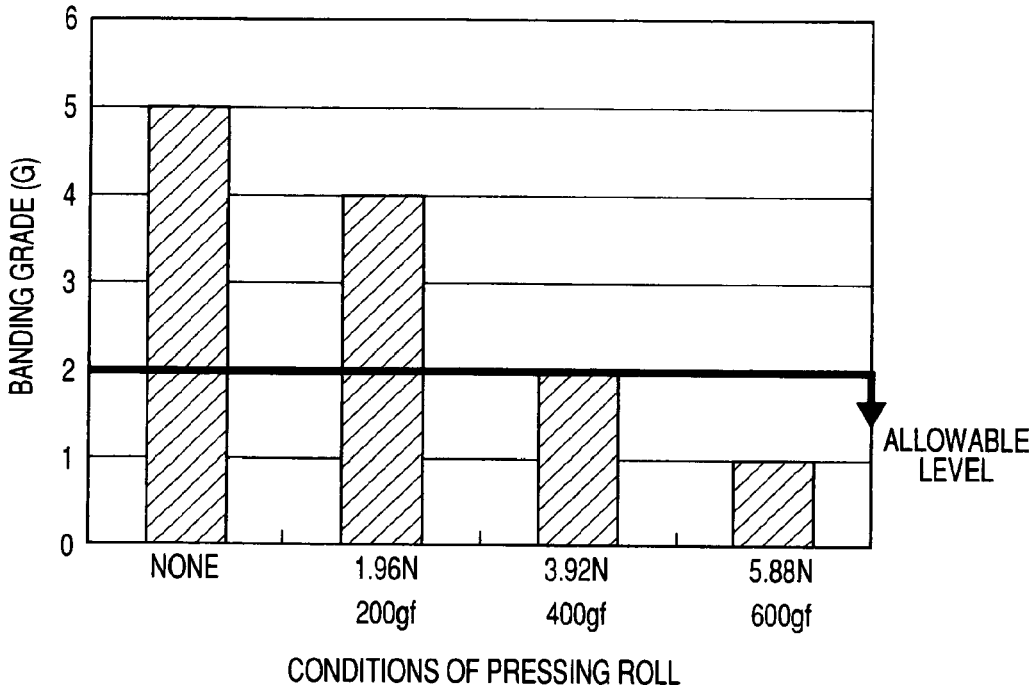
FIG. 10 is a view showing results of experiments on relationships between the pressing force of the pressing roll and the banding occurrence state, wherein 1 denotes photosensitive drum, 2 denotes charging device, 3 denotes exposing device, 4 denotes developing device, 5 denotes primary transfer roll, 6 denotes cleaning device, 7 denotes fixing device, 8 denotes sheet tray, 9 denotes conveying path, 9*a* denotes register roll, 10 denotes image forming unit, 19 denotes primary transferring section, 20 denotes intermediate transfer belt, 21 denotes drive roll, 22 denotes steering roll, 23 denotes backup roll, 24 denotes secondary transfer roll, 25 denotes toner removing device, 26 denotes pressing roll, 27 denotes second pressing roll, 28 denotes third pressing roll, 29 denotes secondary transferring section, 30 denotes opposing roll, 31 denotes tension roll, 41 denotes frame, 42 denotes swing arm, 43 denotes rotation shaft, and 44 denotes driving device.

FIG. 10 is a view showing results of experiments in which the banding occurrence state is checked while changing the force of pressing the pressing rolls 26 against the steering roll 22. The force means the total load which acts on the pressing rolls.

As shown in the figure, when the pressing force is 3.92 N (400 gf) or more, the degree of banding is in an allowable range, and therefore it is preferable to load a force of 3.92 N or more.

When the load is large, the rotary torque is increased. Therefore, it is preferable that the load to be applied to the belt is 19 N (2 kgf) or less.

The pressing rolls 26 may be always contacted with the intermediate transfer belt 20 to apply the load. Alternatively, an image forming apparatus in which either of the monochrome mode and the full-color mode is selectable may be configured in the following manner. When the full-color mode is selected, the pressing rolls 26 is retracted from the position where the rolls are contacted with the intermediate transfer belt 20, so that the load of the circumferential driving of the intermediate transfer belt 20 is reduced, the electric power consumption is suppressed, and abrasions of the intermediate transfer belt 20 and the pressing rolls 26 are reduced. However, it is preferable that, even in the full-color mode, the pressing rolls 26 are contacted with the intermediate transfer belt 20 when a thick sheet is used. Also when the full-color mode is selected and, in place of a thick sheet, a sheet which causes small load fluctuation at the secondary transfer position, such as a PPC sheet is used as the recording sheet, the pressing rolls 26 may be retracted from the intermediate transfer belt 20.

Figure 8:
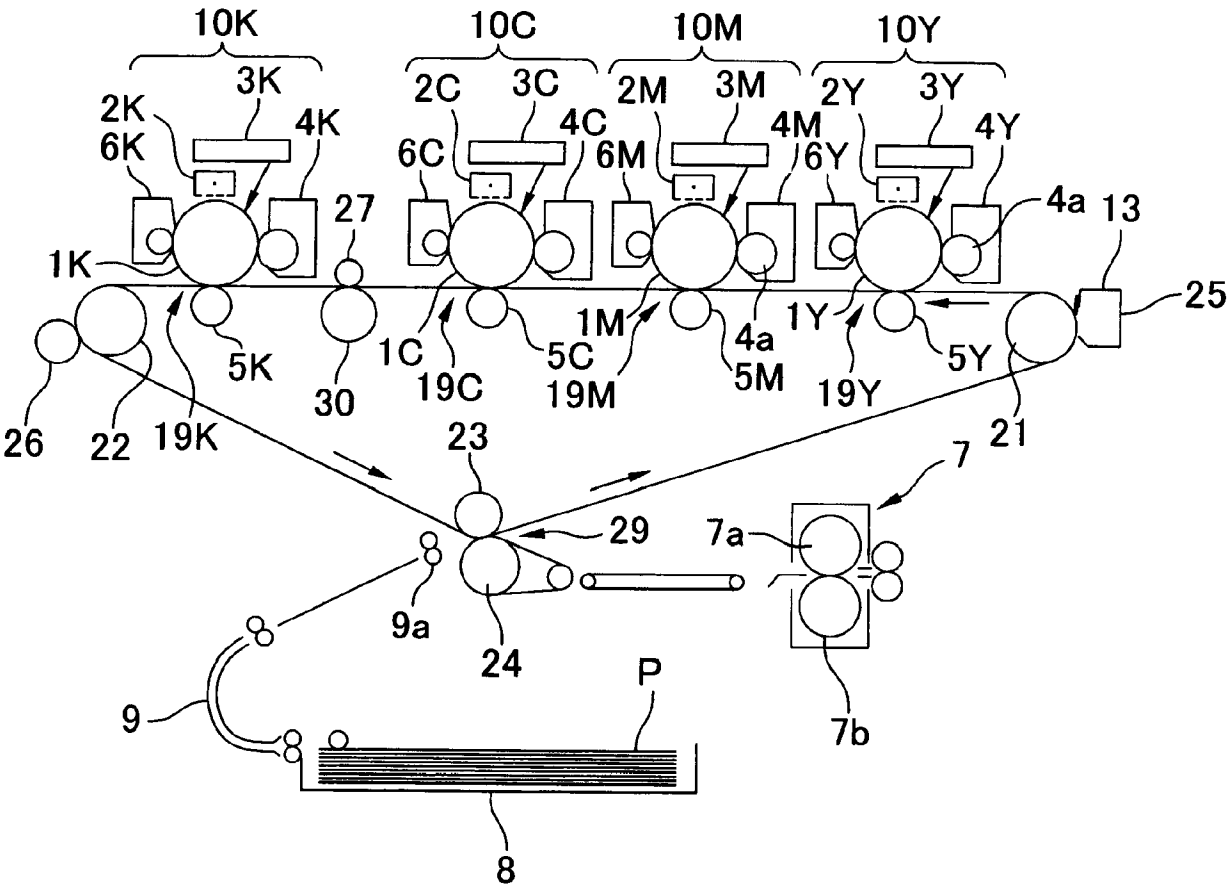
FIG. 8 is a schematic diagram showing an image forming apparatus which is a second embodiment of the invention.

FIG. 8 is a schematic diagram showing an image forming apparatus which is a second embodiment of the invention.

In the same manner as the image forming apparatus shown in FIG. 1, the image forming apparatus includes the four image forming units 10Y, 10M, 10C, 10K, the intermediate transfer belt 20 which is opposed to the units, the secondary transfer roll 24, the fixing device 7, and the pressing rolls 26. Inside the intermediate transfer belt 20, the drive roll 21, steering roll 22, and backup roll 23 which are used for entraining the intermediate transfer belt 20, and also an opposing roll 30 are disposed. The opposing roll 30 is disposed between the position where the photosensitive drum 1C for the cyan toner is opposed to the intermediate transfer belt 20, and that where the photosensitive drum 1K for the black toner is opposed to the intermediate transfer belt. Second pressing rolls 27 are pressed against the opposing roll 30 through the intermediate transfer belt 20. In the same manner as the pressing rolls 26 which are pressed against the steering roll 22, the second pressing rolls are configured so that their deformation applies a load to the circumferential movement of the intermediate transfer belt.

In the image forming apparatus, the pressing rolls 27, 26 are disposed on the upstream and downstream sides of the photosensitive drum 1K for the black toner, respectively, and, when an image is formed in the monochrome mode where only the black toner is used, the phenomenon that fluctuation of the circumferential velocity of the intermediate transfer belt 20 propagates to the primary transferring section 19K for a black toner image is suppressed.

Figure 9:
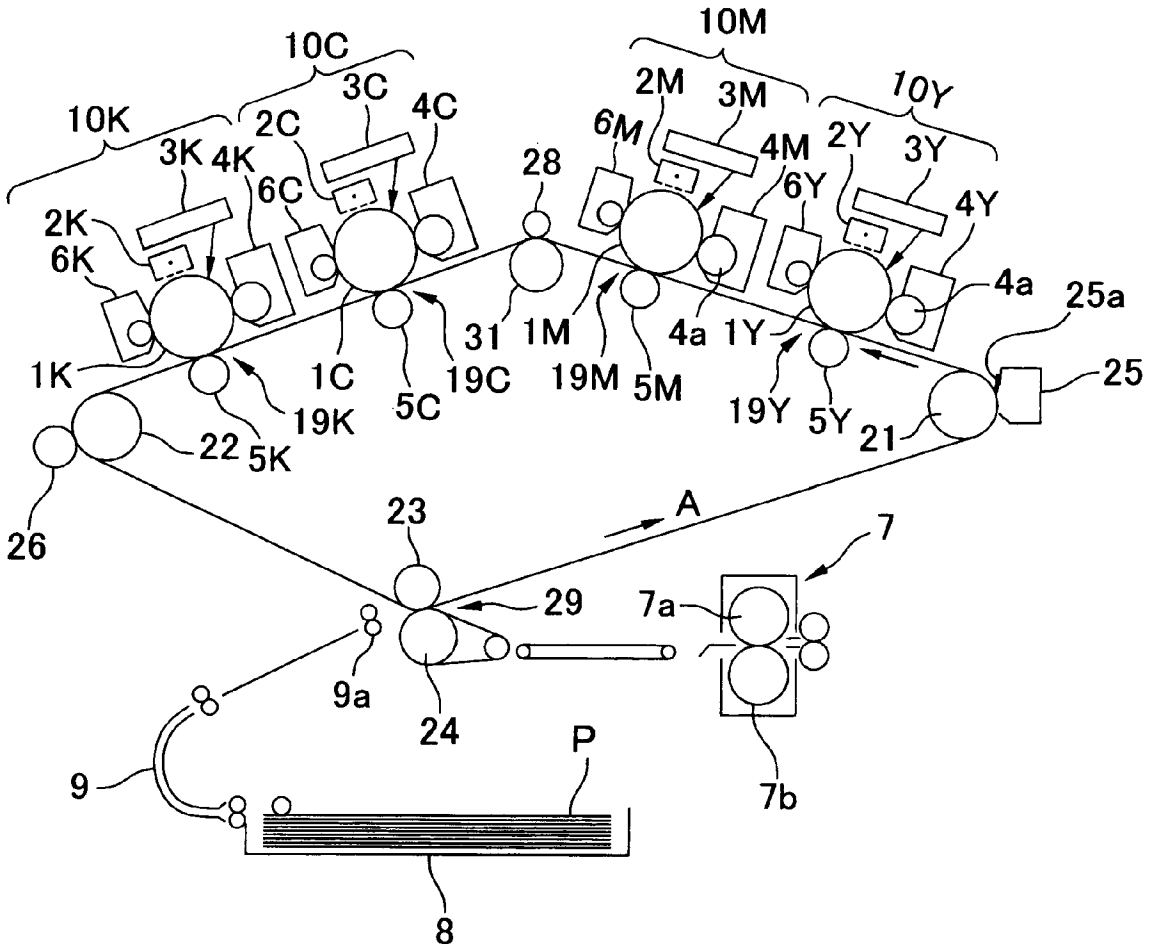
FIG. 9 is a schematic diagram showing an image forming apparatus which is a third embodiment of the invention.

FIG. 9 is a schematic diagram showing an image forming apparatus which is a third embodiment of the invention.

In the same manner as the image forming apparatus shown in FIG. 1, also the image forming apparatus includes the four image forming units 10Y, 10M, 10C, 10K, the intermediate transfer belt 20 which is opposed to the units, the secondary transfer roll 24, the fixing device 7, and the pressing rolls 26. The intermediate transfer belt is entrained so as to be circularly movable, around the drive roll 21, the steering roll 22, the backup roll 23, and a tension roll 31. The tension roll 31 is disposed downstream from the drive roll 21 in the circumferential moving direction of the intermediate transfer belt 20, and upstream from the steering roll 22.

Among the four image forming units, the image forming unit 10Y for forming a yellow toner image and the image forming unit 10M for forming a magenta toner image are opposed to the intermediate transfer belt 20 at positions which are downstream from the drive roll 21 in the circumferential moving direction of the intermediate transfer belt 20, and upstream from the tension roll 31, and the image forming unit 10C for forming a cyan toner image and the image forming unit 10K for forming a black toner image are disposed downstream from the tension roll 31, and upstream from the steering roll 22. Third pressing rolls 28 are disposed at positions where the rolls are opposed to the tension roll 31, and pressed against the intermediate transfer belt 20. In the same manner as the pressing rolls 26 which are pressed against the steering roll 22, the third pressing rolls are configured so that their deformation applies a load to the circumferential movement of the intermediate transfer belt.

In the image forming apparatus, the pressing rolls 28 apply a load to the circumferential movement of the intermediate transfer belt 20 in the region where the plurality of photosensitive drums 1 are arranged along the intermediate transfer belt 20. According to the configuration, with respect to any of the photosensitive drums 1, velocity fluctuation of the circumferential movement is suppressed at a position close to the primary transferring position where the drum is opposed to the intermediate transfer belt 20.

In the region where the image forming units 10Y, 10M, 10C, 10K are placed between the drive roll 21 and the steering roll 22, even when the primary transfer rolls 5 are retracted, the situation that a long distance of the intermediate transfer belt 20 is tensioned without being contacted with another member is avoided, and hence vibration in which the intermediate transfer belt 20 is displaced in the direction perpendicular to the circumferential surface is suppressed.

In the embodiments, rubber rolls in which the circumferential surface is formed by rubber are used as the pressing rolls 26, 27, 28. Alternatively, blades may be used. In the alternative, a load can be applied to the circumferential movement of the intermediate transfer belt 20, by friction between the blade and the intermediate transfer belt 20.

Alternatively, a load may be applied to the circumferential movement of the intermediate transfer belt, by contacting a roll member in which a load is applied to a support shaft, with the intermediate transfer belt.

In the above-described embodiments, the pressing rolls 26, 27, 28 which function as a load applying member are contacted with the intermediate transfer belt 20 at the positions where the rolls are opposed to the steering roll 22, the opposing roll 30, or the tension roll 31. Alternatively, the rolls may be contacted with the intermediate transfer belt at positions where they are opposed to any of roll members which are placed inside the intermediate transfer belt 20.

The foregoing description of the embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention defined by the following claims and their equivalents.

What is claimed is:

1. An image forming apparatus comprising:

a plurality of image carriers, each image carrier having an endless circumferential surface on which a latent image is formed due to an electrostatic potential difference;

a developing device that attaches a toner to the image carrier to form a toner image;

an endless intermediate transfer belt that is entrained around a plurality of roll members and moves circumferentially, and contacts the image carrier to transfer the toner image to the intermediate transfer belt;

a transferring device that further transfers the toner image that has been transferred to the intermediate transfer belt, to a recording sheet; and a load applying member that cooperates with one of the roll members placed inside the intermediate transfer belt, to nip the intermediate transfer belt to apply a load to the intermediate transfer belt, the load applying member contacting a non-image region of the intermediate transfer belt, and the load applying member being placed between one of the plurality of image carriers and another one of the plurality of image carriers.

2. The image forming apparatus according to claim 1, wherein the load applying member is placed upstream in a circumferential moving direction of the intermediate transfer belt from a position where the transferring device is disposed, and downstream from a position where the image carrier faces the intermediate transfer belt.

3. The image forming apparatus according to claim 1, wherein the plurality of image carriers are disposed for respective plural colors including black to form toner images of the plural colors, the plurality of image carriers being arranged along a circumferential direction of the intermediate transfer belt, and the load applying member is placed adjacent to a position where one of the plurality of image carriers for forming a black toner image faces the intermediate transfer belt.

4. An image forming apparatus comprising:

a plurality of image carriers for respective plural colors including black to form toner images of the plural colors, each image carrier having an endless circumferential surface on which a latent image is formed due to an electrostatic potential difference;

a developing device that attaches a toner to the image carrier to form a toner image;

an endless intermediate transfer belt that is entrained around a plurality of roll members and moves circumferentially, and contacts the image carrier to transfer the toner image to the intermediate transfer belt;

a transferring device that further transfers the toner image that has been transferred to the intermediate transfer belt, to a recording sheet;

a load applying member that cooperates with one of the roll members placed inside the intermediate transfer belt, to nip the intermediate transfer belt to apply a load to the intermediate transfer belt, the load applying member contacting a non-image region of the intermediate transfer belt, and the load applying member being supported to be contactable with and separable from the intermediate transfer belt; and a mode selector that selects one of a monochrome mode where only a black toner image is formed, and a color mode where toner images of the plurality of colors are superimposed with each other, wherein when the color mode is selected, the load applying member is separated from the intermediate transfer belt, and, when the monochrome mode is selected, contacted with the intermediate transfer belt.

5. The image forming apparatus according to claim 4, wherein the load applying member is placed upstream in a circumferential moving direction of the intermediate transfer belt from a position where the transferring device is disposed, and downstream from a position where the image carrier faces the intermediate transfer belt.

6. The image forming apparatus according to claim 4, wherein the plurality of image carriers are disposed for respective plural colors including black to form toner images of the plural colors, the plurality of image carriers being arranged along a circumferential direction of the intermediate transfer belt, and the load applying member is placed adjacent to a position where one of the plurality of image carriers for forming a black toner image faces the intermediate transfer belt.

7. The image forming apparatus according to claim 4, wherein the load applying member is placed between one of the plurality of image carriers and another one of the plurality of image carriers.

8. An image forming apparatus comprising:

an image carrier having an endless circumferential surface on which a latent image is formed due to an electrostatic potential difference;

a developing device that attaches a toner to the image carrier to form a toner image;

an endless intermediate transfer belt that is entrained around a plurality of roll members and moves circumferentially, and contacts the image carrier to transfer the toner image to the intermediate transfer belt;

a transferring device that further transfers the toner image that has been transferred to the intermediate transfer belt, to a recording sheet; and a load applying member that cooperates with one of the roll members placed inside the intermediate transfer belt, to nip the intermediate transfer belt to apply a load to the intermediate transfer belt, the load applying member contacting a non-image region of the intermediate transfer belt, and the load applying member being supported to be contactable with and separable from the intermediate transfer belt, a thick-sheet mode is settable in addition to a standard mode, an image can be formed while switching to the thick-sheet mode where a recording sheet is used that is thicker than a recording sheet to be used in the standard mode, and, when an image is formed in the standard mode, the load applying member is separated from the intermediate transfer belt, and, when an image is formed in the thick-sheet mode, contacted with the intermediate transfer belt.

9. The image forming apparatus according to claim 8, wherein the load applying member is placed upstream in a circumferential moving direction of the intermediate transfer belt from a position where the transferring device is disposed, and downstream from a position where the image carrier faces the intermediate transfer belt.

10. The image forming apparatus according to claim 8, wherein the image carrier comprises a plurality of image carriers disposed for respective plural colors including black to form toner images of the plural colors, the plurality of image carriers being, arranged along a circumferential direction of the intermediate transfer belt, and the load applying member is placed adjacent to a position where one of the plurality of image carriers for forming a black toner image faces the intermediate transfer belt.

11. The image forming apparatus according to claim 10, wherein the load applying member is placed between one of the plurality of image carriers and another one of the plurality of image carriers.

* * * * *